United States Patent [19]

Wachtel

[11] 4,246,717

[45] Jan. 27, 1981

[54] BUBBLE PIPE

[75] Inventor: Jack S. Wachtel, Larchmont, N.Y.

[73] Assignee: Joseph R. Ehrlich, New York, N.Y.; a part interest

[21] Appl. No.: 26,528

[22] Filed: Apr. 3, 1979

[51] Int. Cl.[3] ..... A63H 33/28

[52] U.S. Cl. ..... 46/6

[58] Field of Search ..... 46/6, 7, 8

[56] References Cited

U.S. PATENT DOCUMENTS

| | | | |
|---|---|---|---|
| 2,305,382 | 12/1942 | Hagopian | 46/6 |
| 2,366,103 | 12/1944 | Hagopian | 46/6 |
| 2,561,974 | 7/1951 | Corbitt | 46/6 |
| 3,295,248 | 1/1967 | Knerr et al. | 46/6 |
| 3,323,250 | 6/1967 | Gibbons | 46/6 |

*Primary Examiner*—Robert Peshock
*Assistant Examiner*—Mickey Yu
*Attorney, Agent, or Firm*—Jacobs & Jacobs

[57] ABSTRACT

A bubble pipe comprises a wide outer tube and one or more shorter narrower inner tubes that project beyond the outer tube. The inner tube or tubes may be slidable within the outer tube.

6 Claims, 6 Drawing Figures

FIG. 1
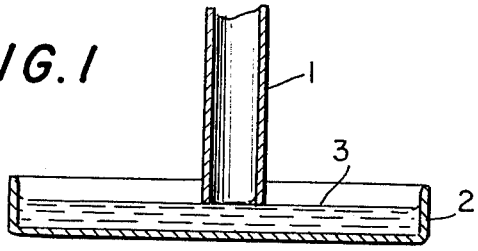
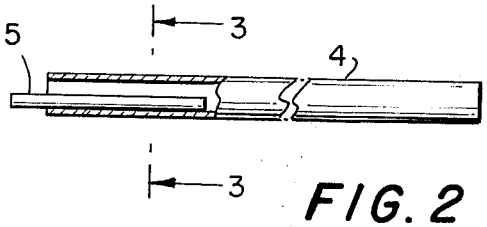
FIG. 2
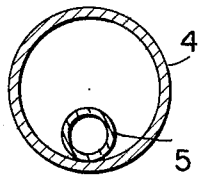
FIG. 3
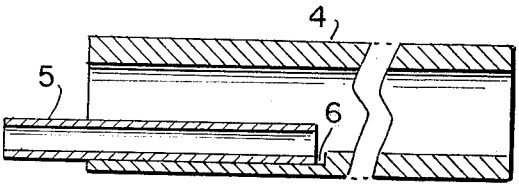
FIG. 4
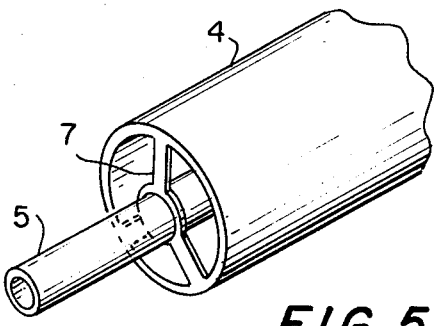
FIG. 5
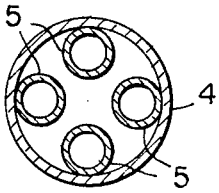
FIG. 6

BUBBLE PIPE

The present invention relates to apparatus for making bubbles from an aqueous bubble composition.

Bubbles have fascinated children and scientists alike. Isaac Newton, J. A. F. Plateau, Dewar and many others have experimented with bubbles, and C. V. Boys published a classic treatise entitled "Soap Bubbles." Despite all of the work done in this field, bubble making is still highly empirical.

All of the prior art bubble compositions have one important characteristic in common: they form wet bubbles that leave marks when they break. Thus, bubble toys have heretofore been relegated to the outdoors, since otherwise the bubbles when they broke would mark or stain furniture, carpeting, etc.

Another characteristic of prior art bubble solutions is the relatively limited number of bubbles formed per puff of air through a pipe or per pass of a wand. Only by special and complex apparatus can large numbers of bubbles be formed.

The present application describes a bubble composition from which "indoor bubbles" are formed. Indoor bubbles are not wet to the touch and do not leave any visible marks and, therefore, are a year-round toy. In addition, indoor bubbles have more play value because they stay around longer, whereas bubbles that are formed outdoors are carried away or are being destroyed by wind much sooner.

The present application also describes a bubble composition for making "vanishing bubbles." Such bubbles are either colorless or lose their color quickly to become progressively thin and transparent until just a faint, barely visible contour remains. At this state the bubbles are floating in the air as if they were weightless. When a person comes close to a bubble with an outstretched finger the bubble moves away and can be directed and moved with the finger into any direction. Some of those bubbles float for many minutes and have a "ghost-like" quality. One can look through them, walk through them as if they were non-existent. It is difficult to pin-point the moment when they finally disappear. When one grabs such bubbles with the hand the bubbles break but the hand remains dry. When such bubbles settle down or break on furniture, clothing, paperwork etc., no visible mark remains. It is a truly eerie experience.

The present invention provides for extremely lightweight bubbles, lighter than any heretofore known.

The present invention further describes a bubble composition for making "snow storm bubbles." These bubbles, with only a single blast of air, flow out of the blowing tube in a sustained stream of bubbles, looking almost like a flowing liquid. Over one-hundred bubbles per puff or blast of air can be produced, a phenomenon quite unlike anything in the prior art. The present invention provides for bubble solutions of unusual great capacity. From any given volume of the liquid one can produce about 40 times more bubbles than from an equal volume of commercial bubble solution.

All of the bubble compositions comprise from 3 to 10% of an aliphatic alkanolamide, from 0.9 to 7% of a surfactant and water, and the total amount of amide and surfactant is at least about 5% but not more than about 15%. It is preferred that the amide be present in an amount of from about 3 to about 7% and that the surfactant be present in an amount of about 1.5 to about 6%, with the total amount of both being preferably from about 5 to about 12%. Glycerin is advantageously also included to provide longer life for the bubbles. When glycerin is employed, the amount is not more than 30%. Further conventional additives can be used as long as they do not adversely affect the composition. For example, sodium chloride can be added to increase the viscosity, but thickening agents such as vegetable gums, cellulosics, alginates and starches must be avoided.

For indoor bubbles, the total solids, i.e. amide, surfactant and any additives, is preferably below about 20%, most preferably below about 12%.

Snow storm bubbles generally contain less water, such as an amount of at least about 40%, due to the presence of at least about 15 to about 35% glycerin and about 4 to about 5% gelatin. The gelatin coacts with the amide and surfactant to give rise to vast numbers of bubbles per blast of air. Urea is also present, to stabilize the gelatin, in the ratio of urea:gelatin of 3:1 to 4.5:1, preferably 3.8:1 to 4.0:1. Formamide or acetamide may also be used instead of urea. As in the case of the indoor bubbles, the total amount of the amide and surfactant is at least about 5% but not more than 15%.

The amide employed is of the formula:

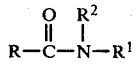

wherein R is an aliphatic radical of at least 11 carbon atoms, $R^1$ is hydroxy lower alkyl, and $R^2$ is hydrogen or hydroxy lower alkyl. Preferably, R is alkyl of 11–18 carbon atoms. The term "hydroxy lower alkyl" is used herein to mean alkyl of 2 to 6 carbon carbons, preferably 2 to 3 carbon atoms, containing one hydroxy group.

Alkanolamides are commercially available that are the reaction products of one or more fatty acids of 12 and more carbon atoms and a lower alkanolamine. Suitable alkanolamides include those formed by reacting lauric, myristic or stearic acid or a mixture of two or more thereof with mono- or diethanolamine or isopropanolamine. A preferred alkanolamide is a lauric diethanolamide sold under the tradename Witcamide 5195, By Witco Chemical Corp., Organics Div., 277 Park Ave., New York, N.Y. 10017. A 10% water solution of this product will start crystallizing after about 10 hours. Crystallization starts at the top of the liquid, with long, needle-like crystals growing down to the bottom. At that point, the entire mass appears to be solid with no loss in weight. With a 7% solution, crystallization takes several days; with a 5.5% solution crystallization takes 6–8 weeks; with a 4.9% solution, 14–15 weeks.

While the amide appears to be the single most important factor that gives rise to the vanishing effect, since no vanishing is observed in the absence of the amide, nevertheless the viscosity of the solution is also important in this regard. Thus, solutions with too low a viscosity would be of little or no play value, because while the bubbles would exhibit the "vanishing" effect, they would rapidly sink. Conversely, when the viscosity becomes too high, the bubbles will last only a few seconds. To have commercial value, the bubbles must float and last long enough to exhibit the "ghost" effect. Accordingly, the solutions desirably have a viscosity of at least about 280 cp, and preferably not more than about 4400 cp, the viscosity being determined with a Brookfield electroviscomiter with spindle No. 4 at 20 rpm. In contrast, presently available commercial bubble solutions have a viscosity of 70 cp.

The surfactant employed in the bubble compositions cooperates with the amide to provide film-forming properties as well as proper viscosity. Suitable surfactants include sulfated or sulfonated alcohols, alkyl-aryl sulfonates, sulfosuccinates, betain derivatives and imidazolinium amphoterics, many of which having a hydrotropic effect so that the solutions remain clear on stroage. Suitable surfactants, and their amounts, with the range of 0.15 to 10%, are empirically determined. In general, it is preferred that the ratio of surfactant to amide be about 1:1 to about 1:7, on a dry basis, preferably from about 1:1 to about 1:4.

Bubbles are blown from the bubble compositions by means of the following "Bubble Blowing Procedure." This procedure is illustrated by the accompanying drawing, in which:

FIG. 1 is an enlarged elevation view of a bubble tube touching a layer of a bubble solution according to the invention;

FIG. 2 is an enlarged elevation view, partly in section, of a bubble tube or pipe according to my invention;

FIG. 3 is an enlarged view taken in section along lines 3—3 of FIG. 2; and FIGS. 4–6 diagrammatically illustrate alternative embodiments of a bubble tube or pipe according to my invention.

Referring to the drawing, the Bubble Blowing Procedure is carried out by using a straight bubble tube or pipe 1 as shown in FIG. 1. Bubble tube 1 has an inner diameter at the bubble-forming end of about 2 to about 13 mm, preferably from about 4 to about 6 mm.

Cap or disc 2 contains a few drops of bubble solution 3 and is only slightly larger than tube 1, e.g. a small bottle cap or any other small, rimmed disc can be used.

A thin film of bubble solution 3 is picked up by tube 1 by just touching the layer of bubble solution 3 on the disc 2 with the end of the tube 1. One then turns the tube 1 with the wet end upwards and gently blows by mouth from the opposite end of the tube a steady stream of air. If the blowing is not more than just a breathing, one produces one or a fewer larger bubbles with diameters from about 25 mm to about 125 mm, depending on the tube diameter. With very slight and very steady air pressure one can produce a succession of bubbles, such as e.g. 10 to 30 bubbles or more of the "vanishing" type, measuring from 3 mm to 55 mm, and approximately 50 to 150 bubbles with one single puff of air, using the snow storm solution. It is easy to use two or more tubes simultaneously to produce hundreds of bubbles with one stroke of air. Instead of using the disc 2 one can, of course, touch the surface of the liquid in a bottle (not shown) containing a large quantity of the solution, but being very careful not to dip the tube into the liquid, lest the desired effect is jeopardized.

It must be emphasized that the entire procedure must be observed. When any one step is omitted the desired effects will not occur.

When holding the tube 1 with the wet end upwards, the liquid cannot run down backwards because it is too viscous and there is not enough liquid to run, just enough to form a film.

Blowing bubbles through a straight tube, simple as it appears to be, is still a game of skill. Within certain limits, and depending on the length and width of the blowing tube, one can blow larger or smaller, more or less bubbles by controlling the breath in length, steadiness and strength. This is especially noticeable when blowing the light-weight delicate bubbles described in this specification. It requires practice, and while this might be part of the fun, there is a way to avoid failures for the unskilled, especially for small children. By slowing down the speed of the flow of air and dividing and distributing it one can obtain uniform results regularly. This can be achieved by using a short piece of a narrow tube inside of a wider and longer tube, with a portion of the narrow tube protruding from the wider tube at the bubble end. Only the end of the protruding narrow tube must be brought in contact with the bubble solution while the air is blown through the mouth end of the wider tube.

This is illustrated in FIGS. 2–6 of the drawing. Thus, FIGS. 2 and 3 illustrate a long wide tube 4 such as 100 mm long and 19 mm in diameter, in which an inner tube 5, such as 40 mm long and 4 mm in diameter, is secured as by adhesive, rivets, heat seal etc. The inner tube 5 may protrude about 10 mm or more. The more the inner tube protrudes, the larger are the bubbles. E.g. if the outer tube 4 is 160 mm long and the inner tube 5 is 140 mm long and protrudes 90 mm, the bubbles would be three times larger than bubbles if the same 140 mm long tube protrudes only 10 mm. Of course the larger bubbles would be considerably less in number than the smaller bubbles. Thus, the bubble pipe of FIGS. 2–6 acts as kind of an equalizer, regulating the number and size of the bubbles without the need of personal skill and practice.

Inner tube 5 can be fixed with respect to tube 4, as in FIGS. 2 and 3, or adjustable, as in FIGS. 4 and 5. Thus, referring to FIG. 4, tube 5 is held by friction in groove 6 and can be manually slid into or out of tube 4 as desired. Similarly, FIG. 5 shows a hub 7 attached to tube 4, with tube 5 movable into and out of tube 4, but held in place by friction once set. Using an inner tube 5 which is not much shorter than the outer tube 4 but is protruding provides a situation where the distance from the mouth to the mouth end of the inner tube 5 is short. This, too, influences the air flow, and with the inner tube 5 being slidable, a variety of blowing conditions are possible.

In FIGS. 2–5, the outer tube 4 will be from about 75 to about 250 mm long and from about 6 to about 20 mm in diameter and the inner tube will be from about 20 to about 200 mm long and from about 2 to about 16 mm in diameter.

FIG. 6 illustrates the case where several inner tubes 5, of e.g. 3 mm in diameter, are fastened to an outer tube 4 of say 13 mm in diameter. A suitable spacing between tubes 5 is 3–5 mm. If the protruding ends of the inner tubes 5 are a uniform distance from each other, hundreds and hundreds of bubbles can easily be blown with one good puff of air.

The bubbles made from the solutions as described herein have considerably thinner walls than bubbles made with solutions of the trade. While floating in the air the bubble walls shrink further drastically in thickness, but the bubbles hardly shrink in diameter. These are the mechanics of the vanishing effect.

To get an idea about the bubble forming capacity of these new bubble solutions and of the relative weight of the bubbles made with them, the following experiment is quite informative.

One drop of solution as described in Example 1 was placed on a watch glass. The drop weighed 0.04 g. The end of a straw with an inner diameter of 4 mm was placed a total of 33 consecutive times on that drop, blowing bubbles each time after touching the drop. The first 15 times a succession of 10 to 18 bubbles was produced, some with a diameter of ¾ in. to 1 in., but most of them having a diameter of about ½ in. The following 9 "touchings" produced 5 to 8 bubbles, each. The next 6 "touchings" gave only 2 to 3 bubbles, each and the last 3 "touchings" gave only 1 bubble, each. The 34th contact with the drop which, by that time, was practically dry did not deliver any other bubble. The "touch-blow" experiment took 264 seconds. The almost dry residue on the watch glass weighed 0.02 g; a small, unweighed amount remained on the straw. While the bubbles were blown and as the solution got more and more concentrated, due to water evaporation, the bubbles started "vanishing" at an increasingly faster rate, finally vanishing within 1 second and less.

Thus, one single drop of the novel bubble solution had the capacity to deliver approximately 280 bubbles under the conditions as described, while drying, and at a temperature of 76° F. and 65% R.H.

A similar experiment was made with a commercially available bubble solution. One drop weighted 0.04 g. A similar straw as in the first experiment was used. With that single drop, 10 times in row only 1 single bubble was produced each time, having a diameter of about ¾ in. The bubbles were colored and were sinking rapidly to the floor. The residue on the watch glass weighed 0.01 g.

The two experiments showed that about 280 bubbles could be made with slightly less than 0.02 g solution and 10 bubbles were made with 0.03 g commercial bubble solution. Thus, the novel bubble solution used in this experiment showed an approximately 42 times greater capacity over the commercial bubble solution, 1 oz. being the equivalent of 5 bottles of 8 liquid ozs., each.

Based on the above described experiment, a further calculation shows that 1 bubble has an estimated average weight of 0.00007 g. The indoor bubble solutions have mostly a water content from 85% to 95%. Assuming an average non-aqueous content of 10%, the residue would weigh 0.000007 g of which about 0.000005 g would be solid. It is not surprising that no visible marks can be discovered on a person or an object after bubbles have disappeared. After the production of 10,000 bubbles there would only be 0.05 g solid material scattered all over in the room. For all practical considerations, this bubble toy is truly an indoor toy.

The present invention is illustrated by the following Examples. Throughout the specification and claims, all parts and proportions are by weight.

Examples 1–10 illustrate the preparation of a "vanishing bubble" composition and Examples 11–12 illustrate a "snow storm" composition. In all of the Examples, the "Bubble Blowing Procedure" was employed using a single tube, as in FIG. 1.

EXAMPLE 1

| Parts | |
|---|---|
| 0.93 | Salt-free coconut dicarboxylated imidazolinium amphoteric (75%) FDR GRMCS No. R-0012343; CTFA adopted name Amphoteric 2 |
| 0.23 | Disodium sulfosuccinate (38%); EMCOL 4161-L36, Witco Chemical Corp. |
| 3.52 | Glycerin |
| 4.84 | Lauric diethanolamide; WITCAMIDE 5195, Witco Chemical Corp. |
| 89.55 | Water |

-continued

| Parts | |
|---|---|
| 0.93 | Sodium lauryl sulfate, U.S.P. |

The first four ingredients are mixed and melted together at a temperature not exceeding 50° C. Water is then added at ambient temperature with stirring and then the sodium lauryl sulfate. The mixture is stirred slowly at moderate heat until the sodium lauryl sulfate has dissolved, after which the solution is left to stand until clear. Water lost by evaporation or otherwise is replaced. A solution with pH 7.5 is obtained, and the pH is adjusted to pH 7.0 with citric acid. The final product has a viscosity of 500 cps. at 72° F. and a film-forming solids of 6.56%. The film-forming solids comprise the amide and surfactants.

Using tubes of 4 mm to 6 mm in diameter, from 10 to 30 bubbles are produced from the bubble solution of Example 1 with each single weak blast of air. The bubbles are colored and begin to "vanish" four to eight seconds after they are formed. They float in the air and last for a long time until they finally disappear.

EXAMPLE 2

| Parts | |
|---|---|
| 4.71 | Lauric diethanolamide (WITCAMIDE 5195) |
| 5.26 | Schercopol LMPS, 40%, a lauric sulfosuccinate, Scher Chemicals, Inc., Clifton, N.J. |
| 3.47 | Glycerin |
| 0.54 | Sodium chloride |
| 0.80 | Sodium lauryl sulfate, U.S.P. |
| 85.21 | Water |

The first three ingredients are mixed and melted, after which part of the water and the sodium chloride is added while the mixture is stirred and heated to a temperature not exceeding 60° C. The sodium lauryl sulfate is then added and the balance of the water, while stirring. The solution is left standing to clear and cool to room temperature. A viscous solution of 2200 cp., pH 7.0, and a film-forming solid of 7.61% is obtained. Total solids, 8.15%.

Twenty to forty bubbles are made for each puff with this solution. They start vanishing in 2 seconds and float for a relatively long time. The bubbles are dry to the touch.

EXAMPLE 3

| Parts | |
|---|---|
| 4.50 | Lauric diethanolamide (WITCAMIDE 5195) |
| 8.20 | Ammonium lauryl ether sulfate 50%; EQUEX AEM Proctor & Gamble Distributing Co., Cranford, N.J. |
| 1.40 | Glycerin |
| 4.00 | Triethanolamine |
| 1.40 | Sodium chloride |
| 80.50 | Water |

A bubble solution is prepared using the general procedure of Example 1 by melting the first four ingredients and then adding water and sodium chloride. The solution has a viscosity of 500 cp; pH 7.0 and a total film-forming solids of 8.60. (Total solids, 10%).

This solution yields 40 or more bubbles per puff. The bubbles are colorless and slow to vanish.

EXAMPLE 4

| Parts | |
|---|---|
| 7.0 | Lauric diethanolamide (WITCAMIDE 5195) |
| 7.6 | Schercopol LMPS, 40% |
| 1.8 | Glycerin |
| 82.6 | Water |
| 1.0 | Sodium lauryl sulfate, U.S.P. |

A bubble solution is prepared following the general procedure of Example 1 by melting the first three ingredients, followed by addition of water and sodium lauryl sulfate. The solution has a viscosity of 3000 cp, a pH of 7.0, a film-forming solids of 11.04% and a total solids of 11.04%.

About 20 to 30 bubbles per puff are formed. These bubbles are colorless and immediately vanishing, and float for a long time.

EXAMPLE 5

| Parts | |
|---|---|
| 4.0 | Lauric/myristic ethanolamine. This is formed from 70/30 mixture of lauric and myristic acids in a equimolar ratio of acid to diethanolamine MONAMIDE 150-LMW-C, Mona Industries, Paterson, N.J. |
| 2.0 | Glycerin |
| 0.50 | Triethanolamine |
| 2.5 | Equex AEM |
| 1.0 | Sodium lauryl sulfate, U.S.P. |
| 90.0 | Water |

A bubble solution is prepared using the general procedure of Example 1 by melting the first four ingredients and then adding water and sodium lauryl sulfate. The solution has a viscosity of 3200 cp; pH 7.0 and a film-forming solids of 6.25%.

Bubbles made with this solution vanish in 4–5 seconds so completely that one can hardly see them, yet they float around for a long time before disappearing. The blowing tube must be slightly pressed against the bottom of the disc containing the solution lest no film will form at the end of the tube.

EXAMPLE 6

| Parts | |
|---|---|
| 5.44 | Lauric diethanolamide 1:1, Clindrol 100-L, Clintwood Chemical Company, Chicago, Illinois. |
| 2.57 | Glycerin |
| 4.11 | BioTerge As-90F, an Alpha Olefin Sulfonate, STEPAN Chemical Co., Northfield, Illinois |
| 87.32 | Water |

A bubble solution is prepared using the general procedure of Example 1 by melting the first three ingredients and then adding water. The solution has a viscosity of 1800 cp., pH 7.0 and a film-forming solids of 9.55%.

This solution yields 10 to 20 slightly colored "ghost" bubbles, which quickly vanish and then float for a short while.

Examples 7 to 9 show the preparation of vanishing bubbles that are produced in sufficiently large amounts per puff as to qualify as snow storm bubbles as well.

EXAMPLE 7

| Parts | |
|---|---|
| 5.51 | Lauric diethanolamide (WITCAMIDE 5195) |
| 4.92 | Glycerin |
| 6.50 | Equex AEM |
| 1.57 | Triethanolamine |
| 81.50 | Water |

A bubble solution is prepared using the general procedure of Example 1 by melting the first four ingredients and then adding water. The solution has a viscosity of 4000 cp., pH 7.0 and a film-forming solids of 8.76%.

As many as 70 bubbles per puff are formed. The bubbles are vanishing and long floating.

EXAMPLE 8

| Parts | |
|---|---|
| 4.76 | Lauric diethanolamide (WITCAMIDE 5195) |
| 5.30 | Schercopol LMPS |
| 3.50 | Glycerin |
| 86.44 | Water |

A bubble solution is prepared using the general procedue of Example 1 by melting the first three ingredients and then adding water. The solution has a viscosity of 1400 cp., pH 7.2 and a film-forming solids of 6.87%.

This solution produces an indoor snow storm of 80 and more beautifully colored, very fast vanishing bubbles, per puff.

EXAMPLE 9

| Parts | |
|---|---|
| 6.00 | Lauric diethanolamide (WITCAMIDE 5195) |
| 2.00 | Glycerin |
| 1.00 | Amphoteric 2 (see Example 1) |
| 1.20 | Sodium lauryl sulfate U.S.P. |
| 94.90 | Water |

A bubble solution is prepared using the general procedure of Example 1 by melting the first three ingredients and then adding water and sodium lauryl sulfate. The resulting solution has a viscosity of 1000 cp, pH 7.2 and a film-forming solids content of 8.7%.

The solution yields more than 60 colored, immediately vanishing, lightweight bubbles per puff, and hence is a type of snow storm composition.

EXAMPLE 10

| Parts | |
|---|---|
| 4.15 | Lauric diethanolamide (WITCAMIDE 5195) |
| 4.54 | EQUEX AEM |
| 90.52 | Gelatin solution 369 |
| 0.79 | Sodium Lauryl Sulfate, U.S.P. |

Gelatin solution 369 is prepared by sequentially adding to a container 8.2 parts gelatin (300 Bloom Gram), 32.0 parts urea, 92.0 parts water and 50.0 parts glycerin. and letting the mixture stand for several hours. The mixture is then heated in a water bath with lively agitation until all gelatin has dissolved. The water content of the solution is adjusted by heating to remove water or by adding water to give 164.2 parts of total solution. The solution thus formed has an almost infinite shelf life without preservatives. Gelatin solution 369 contains

| Parts | |
|---|---|
| 5.05 | Gelatin |
| 19.70 | Urea |
| 30.79 | Glycerin |
| 44.46 | Water |

The "snow storm" solution is prepared by mixing the 90.52 parts of gelatin solution 369, the Witcamide 5195, the Equex AEM and the sodium lauryl sulfate, with stirring at moderate speed until all is dissolved. The resulting solution has a pH of 6.8, which is adjusted to 7.0 with triethanolamine.

The final product has a viscosity of 400 cp., pH 7.0 and a total film-forming solids of 7.21%. Total solids, 29.47%. This solution yields 120–150 colored, long floating, non-vanishing bubbles with a single, soft blast of air with a tube of 4 mm inner diameter from a fraction of a droplet of liquid.

EXAMPLE 11

| Parts | |
|---|---|
| 4.78 | Schercopol LMPS |
| 6.05 | Lauric diethanolamide (WITCAMIDE 5195) |
| 4.50 | Equex AEM |
| 84.67 | Gelatin Solution 369 |

The first three ingredients are melted and then gelatin solution is added. The mixture is heated slightly and stirred until all is dissolved. Replace any lost water.

The resulting solution has a pH of 6.9, which is adjusted to pH 7.0. The final product has a viscosity of 450 cp, pH 7.0, a film-forming solids of 10.21% and a total solids of 31.73%.

This solution yields even more beautifully colored, non-vanishing bubbles than the solution of EXAMPLE 10. The bubbles are very light in weight. A single blast of air yields 100 to 170 bubbles.

EXAMPLE 12

| Parts | |
|---|---|
| 4.8 | Lauric diethanolamide (WITCAMIDE 5195) |
| 10.0 | Equex AEM |
| 0.2 | Sodium Chloride |

-continued

| Parts | |
|---|---|
| 85.0 | Gelatin Solution 369 |

A bubble solution is prepared using the general procedure of Example 11 by melting the first two ingredients and then adding the gelatin solution 369 and sodium chloride. The solution has a viscosity of 400 cp., pH 7.0 and a film-forming solids of 9.8%. Total solids 31.04%.

A single blast of air will produce 60 to 100 bubbles from this solution. Though the bubbles are not vanishing, they are so light in weight that they could be made indoors.

The bubble composition described herein are the invention of Joseph R. Ehrlich and is described and claimed in his application filed concurrently herewith.

What is claimed:

1. A bubble pipe for blowing bubbles by mouth, comprising an outer tube having one end adapted to be used as a mouthpiece for blowing bubbles, and a plurality of shorter and narrower inner tubes connected to the other end of said outer tube with at least a portion of each said inner tube projecting beyond said outer tube, said inner tubes being spaced apart within the outer tube with an area of free space between them for permitting air blown through the outer tube to exit from the outer tube while by-passing the inner tubes, the projecting ends of said inner tubes being free from one another to allow only said projecting ends to be wetted by a bubble composition, said pipe being operable to form bubbles only when air is blown through said mouthpiece, part of the air blown through the outer tube being divided and distributed among the inner tubes and part passing through said free space and by-passing the inner tubes.

2. A bubble pipe according to claim 1, wherein said inner tubes are connected to said outer tube in parallel relation with the projecting ends being unconnected to and spaced sufficiently from one another to avoid fusing of the emerging bubbles.

3. A bubble pipe according to claim 2, wherein said inner tubes are disposed symmetrically within said outer tube and providing a central area of said free space.

4. A bubble pipe according to claim 3, wherein said inner tubes project from 10 mm to 90 mm beyond said outer tube.

5. A bubble pipe according to claim 4, wherein each said inner tube has a diameter of from 2 mm to 16 mm.

6. A bubble pipe according to claim 5, wherein said outer tube has a length of from 75 to about 250 mm and a diameter of 6 to 20 mm.

* * * * *